US005459957A

United States Patent [19]

Winer

[11] Patent Number: 5,459,957

[45] Date of Patent: Oct. 24, 1995

[54] GUN SECURITY AND SAFETY SYSTEM

[76] Inventor: Guy T. Winer, P.O. Box 24, Maple Ave., Barclay, Md. 21607

[21] Appl. No.: 257,605

[22] Filed: Jun. 9, 1994

[51] Int. Cl.[6] ..... F41A 17/06

[52] U.S. Cl. ..... 42/70.11

[58] Field of Search ..... 42/70.11, 84

[56] References Cited

U.S. PATENT DOCUMENTS

| | | | |
|---|---|---|---|
| 716,946 | 12/1902 | Seoane . | |
| 2,803,910 | 8/1957 | Lyle | 42/70.11 |
| 3,939,679 | 2/1976 | Barker et al. . | |
| 4,003,152 | 1/1977 | Barker et al. . | |
| 4,067,132 | 1/1978 | Smith . | |
| 4,105,885 | 8/1978 | Orenstein | 42/84 |
| 4,354,189 | 10/1982 | Lemelson . | |
| 4,450,545 | 5/1984 | Kishi et al. . | |
| 4,457,091 | 7/1984 | Wallerstein . | |
| 4,467,545 | 8/1984 | Shaw, Jr. . | |
| 4,471,683 | 9/1984 | Brown . | |
| 4,472,617 | 9/1984 | Ueda et al. . | |
| 4,534,056 | 8/1985 | Feilchenfeld et al. . | |
| 4,563,827 | 1/1986 | Heltzel | 42/70.11 |
| 4,590,604 | 5/1986 | Feilchenfeld . | |
| 4,682,435 | 7/1987 | Heltzel . | |
| 4,716,593 | 12/1987 | Hirai et al. . | |
| 4,763,431 | 8/1988 | Allan et al. . | |
| 4,827,520 | 5/1989 | Zeinstra . | |
| 4,987,693 | 1/1991 | Brooks . | |
| 5,016,376 | 5/1991 | Pugh . | |
| 5,022,175 | 6/1991 | Oncke et al. . | |
| 5,062,232 | 11/1991 | Eppler . | |
| 5,068,900 | 11/1991 | Searcy et al. . | |
| 5,090,148 | 2/1992 | Brooks . | |
| 5,123,193 | 6/1992 | Pugh | 42/70.11 |
| 5,140,766 | 8/1992 | Brooks . | |
| 5,214,707 | 5/1993 | Fujimoto et al. . | |
| 5,303,495 | 4/1994 | Harthcock | 42/70.11 |

*Primary Examiner*—Charles T. Jordan
*Assistant Examiner*—Theresa M. Wesson
*Attorney, Agent, or Firm*—Bradford E. Kile; Ruffin B. Cordell; Michael J. McKeon

[57] ABSTRACT

A security and safety mechanism for a firearm including a disabling unit that interacts with a firearm grip safety in order to enable/disable the firearm. The firearm will remain in a disabled state unless a verification means determines that a firearm user is an authorized firearm user. The security and safety mechanism utilizes voice recognition technology in order to ascertain whether a firearm user is an authorized firearm user.

25 Claims, 5 Drawing Sheets

GUN SECURITY AND SAFETY SYSTEM

BACKGROUND OF THE INVENTION

This invention relates to a novel security and safety mechanism for firearms. More specifically, this invention relates to a security and safety mechanism that utilizes voice pattern recognition to selectively enable operation of a firearm to permit only an authorized user to fire the weapon.

One of the most frequently used classes of firearms by law enforcement agencies worldwide are semi-automatic handguns such as the 9 millimeter or 38 caliber semi-automatic weapons. Standard in these weapons is a thumb safety and grip safety which act to hinder unintentional firearm discharges. These mechanisms are almost universally used to provide a modicum of insurance against unintentional discharge of the weapon. The thumb safety operates by manually shifting the safety lever from its "safe" position to its "fire" position. The grip safety is automatically shifted to its "fire" position when the user's hand engages the stock of the weapon. Neither of these safety mechanisms is wholly effective to prevent the unauthorized use of the firearm, and these have proven unsatisfactory in dealing with a variety of safety concerns.

One area of safety concern is the complete prevention of accidental discharge so as to avoid unintentional injuries and/or death. Another safety concern involves weapons which come into the reach of children or inexperienced firearm users which are accidentally or improperly discharged resulting in serious injury and/or death. Further, a great concern of law enforcement officials is the unfortunate occurrence where a law enforcement officer is shot or killed with the officer's own service weapon. Such incidents most often occur during an attempted arrest of a violent subject who gains control of the officer's service weapon and then uses it against him. In all, 71 law enforcement officers were killed in the line of duty in 1991. Firearms were used in 68 of those slayings, including eight (11.3 percent) in which officers were killed with their own service weapons.

There have been several suggested measures to make firearms safer. These include loading indicators, increasing trigger pressure to make firearms more difficult to fire, automatic safety locks, and limits on muzzle velocity. However, these safety mechanisms still permit any individual, such as a child or criminal, to use the weapon if confiscated from an authorized user.

Some prior art devices utilize gun locks that require that a combination or code be entered into a key pad located on the weapon in order to allow the firing mechanism to operate. These devices are deficient because in a hostile situation the user would find it difficult to press the proper code keys. Furthermore, such devices are not unique to a given user because anyone who has the proper code entry could enable the weapon. A significant problem with these prior art devices is that if a law enforcement officer is disarmed of an enabled weapon (i.e. the code has been previously entered) during an altercation with a criminal suspect, the criminal could retrieve the enabled weapon and use it against the enforcement officer. Additionally, these devices require costly and difficult modifications to the firing mechanism and related structures.

There have been prior art attempts to provide a firearm with means to make that weapon operable only by specific authorized users. Some prior art devices require that the user wear a special signal generating component, such as a ring, bracelet, or glove. In these devices, the firing mechanism will only operate in the presence of a signal generated by the active device. These devices are deficient for several reasons. First, the active components are cumbersome and uncomfortable to wear, decreasing user acceptance and making the system less reliable. Furthermore, the devices are still not unique to a given user because the weapon would still operate for anyone who had the required signal generator. Still further, the weapon cannot be enabled quickly if the user is not presently wearing the signal generating device. Additionally, the incorporation of the disabling mechanism of these devices involves costly and difficult modifications to the firing mechanism. The firing mechanism of a semiautomatic handgun is a precise and delicate structure. The action of the handgun depends on a precise combination of factors such as muzzle pressures, component mass, and hammer spring tension. More modern designs are further complicated through the use of composite materials and sealed firing pin chambers. Modification of the firing mechanism to incorporate additional safety devices is a difficult and undesirable process.

Another prior art attempt to provide an improved safety mechanism overcame the problems associated with a separate signal generating means by utilizing palm or finger print information. In this device, a scanning circuit scans a portion of the hand of an individual and compares the scanned pattern with a stored pattern. A blocking mechanism for blocking movement of the firing hammer is only removed when a scanned pattern matches a stored pattern of an authorized user. This device is deficient because it is unreliable in use. If an officer needed to utilize his weapon in a hostile situation, he would be forced to await a recognition signal before the blocking mechanism would free the firing hammer. Furthermore, the scanning element would easily be weathered and damaged thereby decreasing the reliability of the device. As with other prior art devices, this device is further deficient because it involves costly and difficult alterations to the firing pin mechanism.

The difficulties suggested in the preceding are not intended to be exhaustive but rather among many which may tend to reduce the effectiveness and satisfaction with prior security and safety systems for firearms. Other noteworthy problems may also exist; however, those presented above should be sufficient to demonstrate that firearm security and safety systems of the past will admit to worthwhile improvement.

OBJECTS AND BRIEF SUMMARY OF THE INVENTION

It is therefore a general object of the invention to provide a novel firearm security and safety system which will obviate or minimize difficulties of the type previously described.

It is a specific object of the invention to provide a firearm security and safety system which will permit only an authorized user to enable the firearm for standard operation.

It is another object of the invention to provide a firearm security and safety system that provides for a secure and safe operating weapon, while still assuring standard operation so as not to sacrifice firearm performance.

It is another object of the invention to provide a firearm security and safety system whereby user recognition is completely unique to a given firearm user.

It is still another object of the invention to provide a firearm security and safety system which provides for user recognition means without the use of separate signal generators.

It is a further object of the invention to provide a firearm security and safety system whereby the user can easily enable the firearm even in a hostile situation.

It is yet a further object of the invention to provide a firearm security and safety system which utilizes voice recognition technology in order to provide for reliable and accurate user verification.

It is still another object of the invention to provide a firearm security and safety system which requires no costly and difficult modifications to the firing mechanism.

It is still a further object of the invention to provide a firearm security and safety system whereby if an enabled firearm is removed from an authorized user, such as during an altercation, the firearm will automatically disable itself.

BRIEF SUMMARY OF A PREFERRED EMBODIMENT OF THE INVENTION

A preferred embodiment of the invention which is intended to accomplish at least some of the foregoing objects includes a firearm having a handle, a barrel connected to the handle, and a firing mechanism. The firearm of the preferred embodiment further includes a grip safety operable between first and second positions such that the firing mechanism will only operate when the grip safety is in the second position. A disabling unit comprising a solenoid operably connected to a blocking element acts to block the grip safety from movement from the first position (i.e. where the firing mechanism is inoperable) to the second position (i.e. where the firing mechanism is operable). The firearm of the preferred embodiment further includes verification means operably connected to the solenoid such that a blocking element will only be removed from its blocking position when an authorized user is identified by the verification means. The verification means includes a microphone which collects a voice sample during a polling period and compares the collected voice sample with a previously stored voice sample in order to verify that a firearm user is the authorized firearm user.

DRAWINGS

Other objects and advantages of the present invention will become apparent from the following detailed description of a preferred embodiment thereof taken in conjunction with the accompanying drawings, wherein.

DETAILED DESCRIPTION

Figure 1:
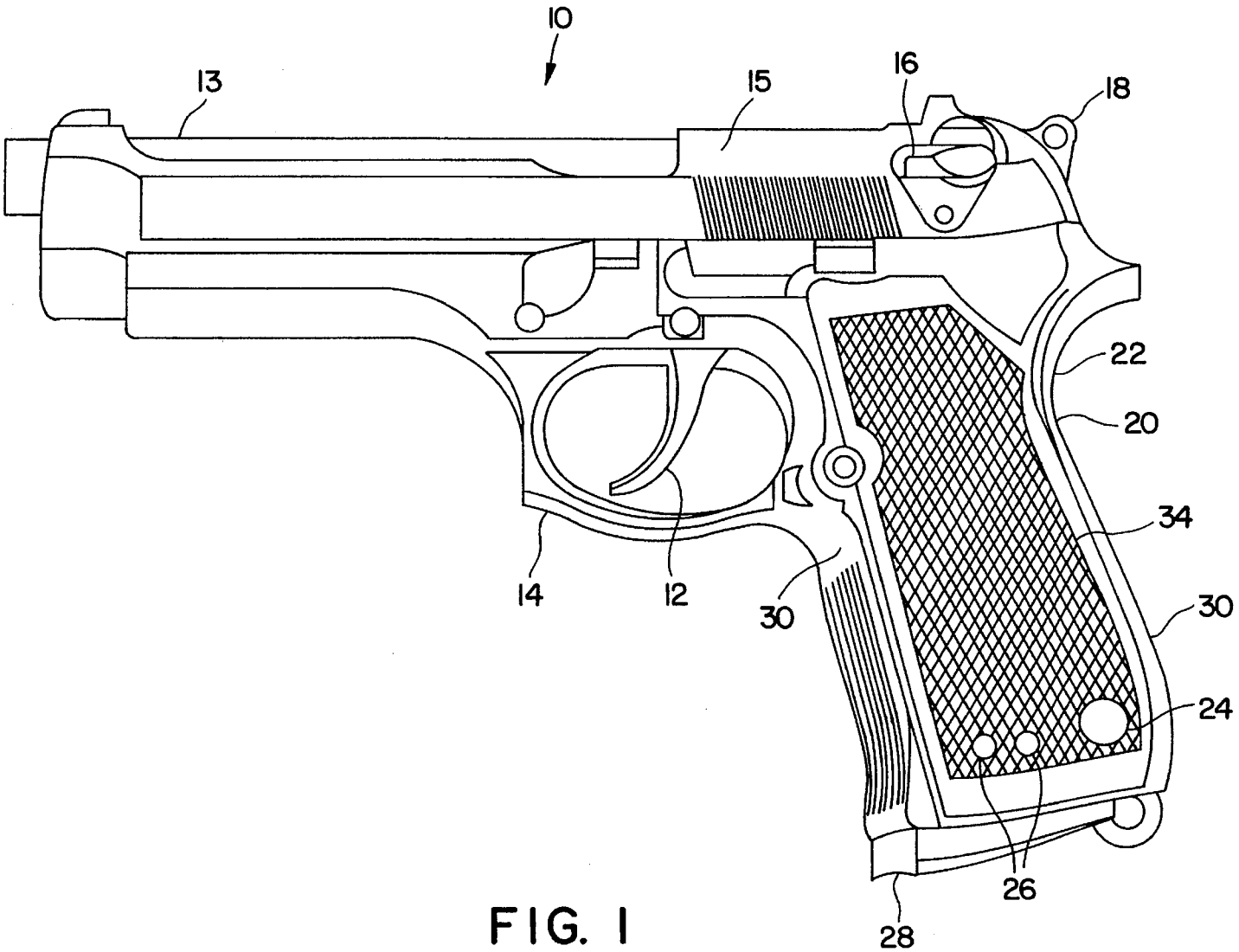
FIG. 1 is a side view of a firearm with a handle containing the security and safety mechanism of the invention.

Referring to FIG. 1, a firearm 10 of the semi-automatic type is shown. Preferably, the safety and security system of the present invention can be used with a standard 9-millimeter semi-automatic service weapon. As in standard semi-automatic weapons, firearm 10 includes a trigger 12, trigger guard 14, hammer 18, barrel 13, slide 15, and handle 20. The firing mechanism, as hereinafter referenced, is considered to consist of the trigger 12, hammer 18, firing pin (not shown), and slide 15. As conventional, mechanical thumb safety 16 is also provided. Grip safety 22 comprises a conventional grip safety panel member which protrudes from the rear surface 32 of the handle 20. Some grip safety designs may alternatively comprise a panel that protrudes from a front surface 30. In such a case, the present invention may simply be applied to the front panel in the manner described with respect to the rear panel. Grip safety 22 mechanically interacts with the firing mechanism such that the firing mechanism is inoperable when the grip safety is in a first outward position and operable when the grip safety is in a second inward position. Conventionally, when a firearm user engages the firearm 10, a portion of the user's hand will push the grip safety from a first outward position to a second inward position, thus permitting operation of the firing mechanism. The actual transverse movement of grip safety panel is very small, nominally on the order of 1–3 millimeters. However, this movement is sufficient to enable or disable the firearm. When firing of the weapon is desired, the user would deactivate the thumb safety and grip the firearm handle thereby pushing the grip safety inward in order to permit operation of the firing mechanism. The grip safety design prevents unintentional weapon firings when, for example, the firearm is dropped or mishandled.

Figure 2:
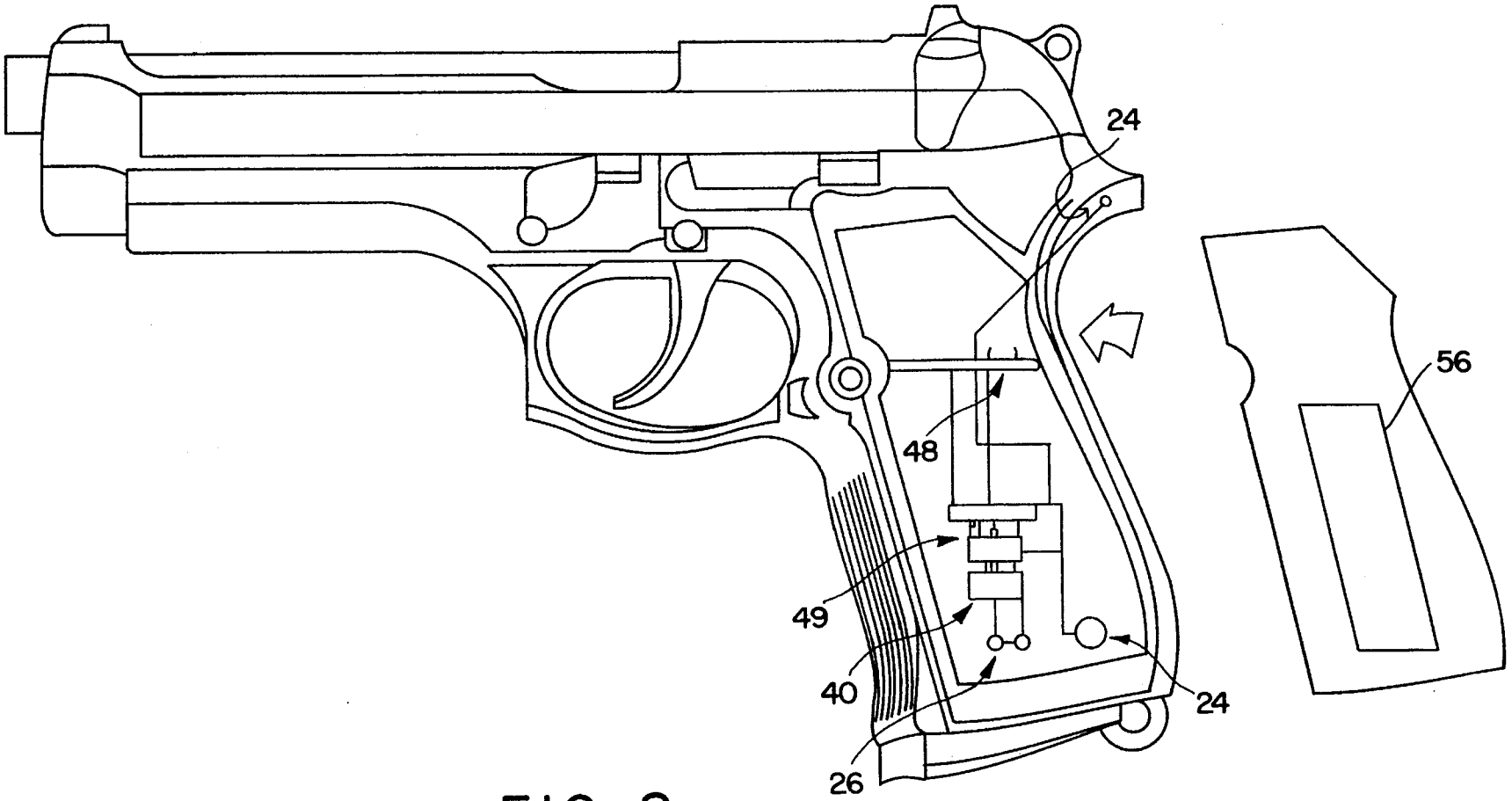
FIG. 2 is a side cut away view of the firearm showing a block representation of the placement of circuit components in accordance with the invention.
Figure 3:
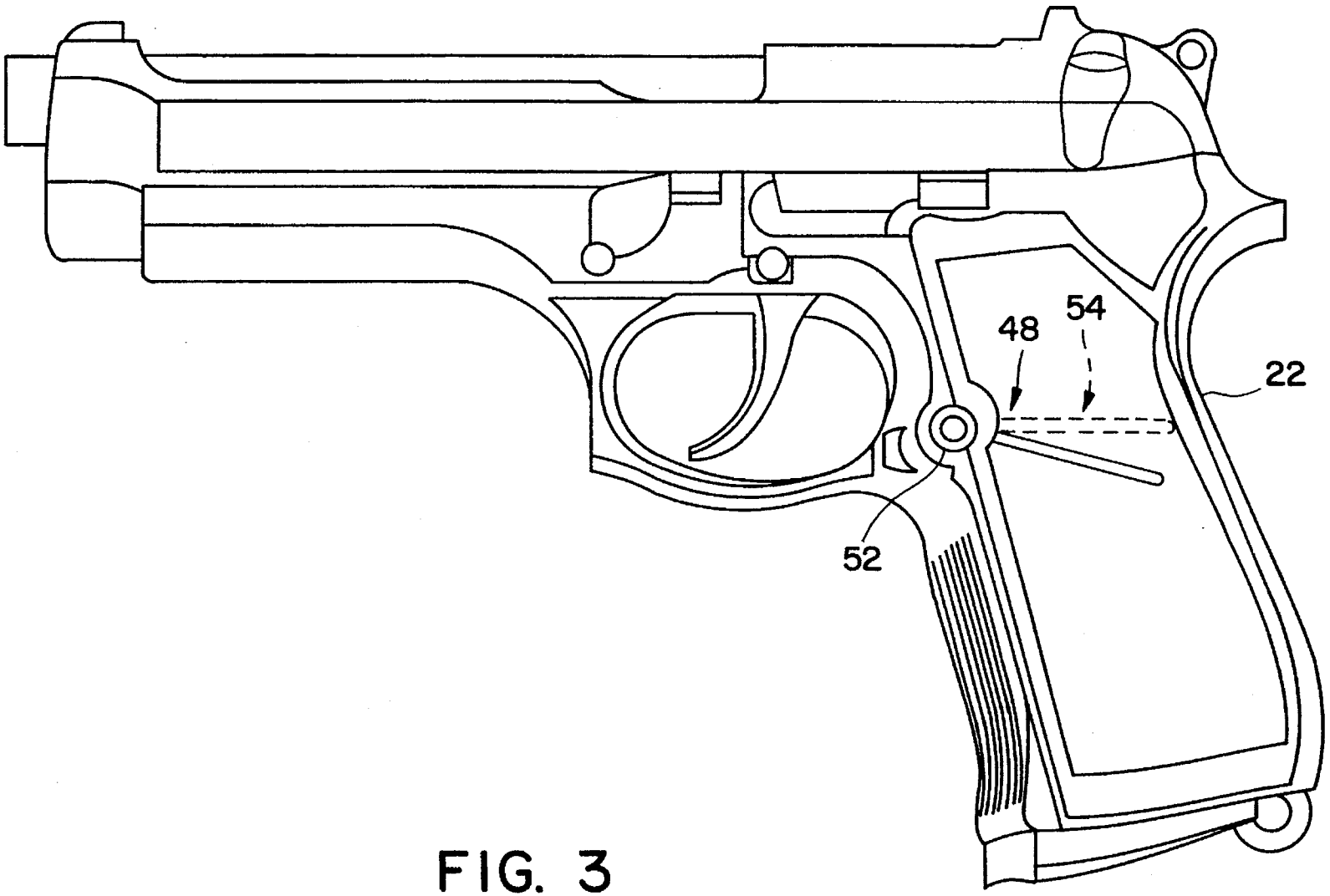
FIG. 3 is a side cut away view of the firearm showing the solenoid and blocking element in their blocking and retracted positions in accordance with the invention.

The preferred embodiment of the invention includes disabling unit 48 shown in FIGS. 2 and 3. The disabling unit includes solenoid 52 which is operably attached to blocking lever or bar 54. When the firearm has been enabled by an authorized user, as described below, the solenoid is positioned such that the blocking lever 54 is retracted from the path of grip safety 48. The shaded blocking lever 54 as shown in FIG. 3 indicates this retracted position of the blocking lever. When the firearm has been enabled by an authorized user, the weapon will operate in a standard mode of operation. That is, when the user desires to fire the weapon, the thumb safety must be deactivated and the grip safety, which is now free to move, must be moved from a first outward position to a second inward position thereby allowing the firing mechanism to operate. When the firearm is disabled, as described below, the solenoid rotates thereby moving the blocking lever into the path of the grip safety. The phantom blocking lever 54 as shown in FIG. 3 indicates this blocking position of the blocking lever. In this position, the grip safety is not permitted to move from its first outward position to its second inward position thereby rendering the firing mechanism inoperable. The firearm is now disabled.

An important aspect of the present invention is that the grip safety mechanism described above is a standard component of most semiautomatic handguns currently in use. The complex interaction of the grip safety and the firing pin mechanism is already in place in these weapons. The disabling unit interacts with the grip safety to place the weapon in an enabled or disabled state, and the grip safety in turn mechanically interacts with the firing mechanism to render the firing mechanism operable or inoperable. The present invention does not require modification of the firing pin mechanism but instead acts to selectively enable or disable movement of the grip safety itself, thereby avoiding complex modifications to the firing pin mechanism. This significant design improvement avoids having to alter or redesign the firing mechanism resulting in significant savings in manufacturing cost and avoiding the need for complicated specialized components.

Figure 4:
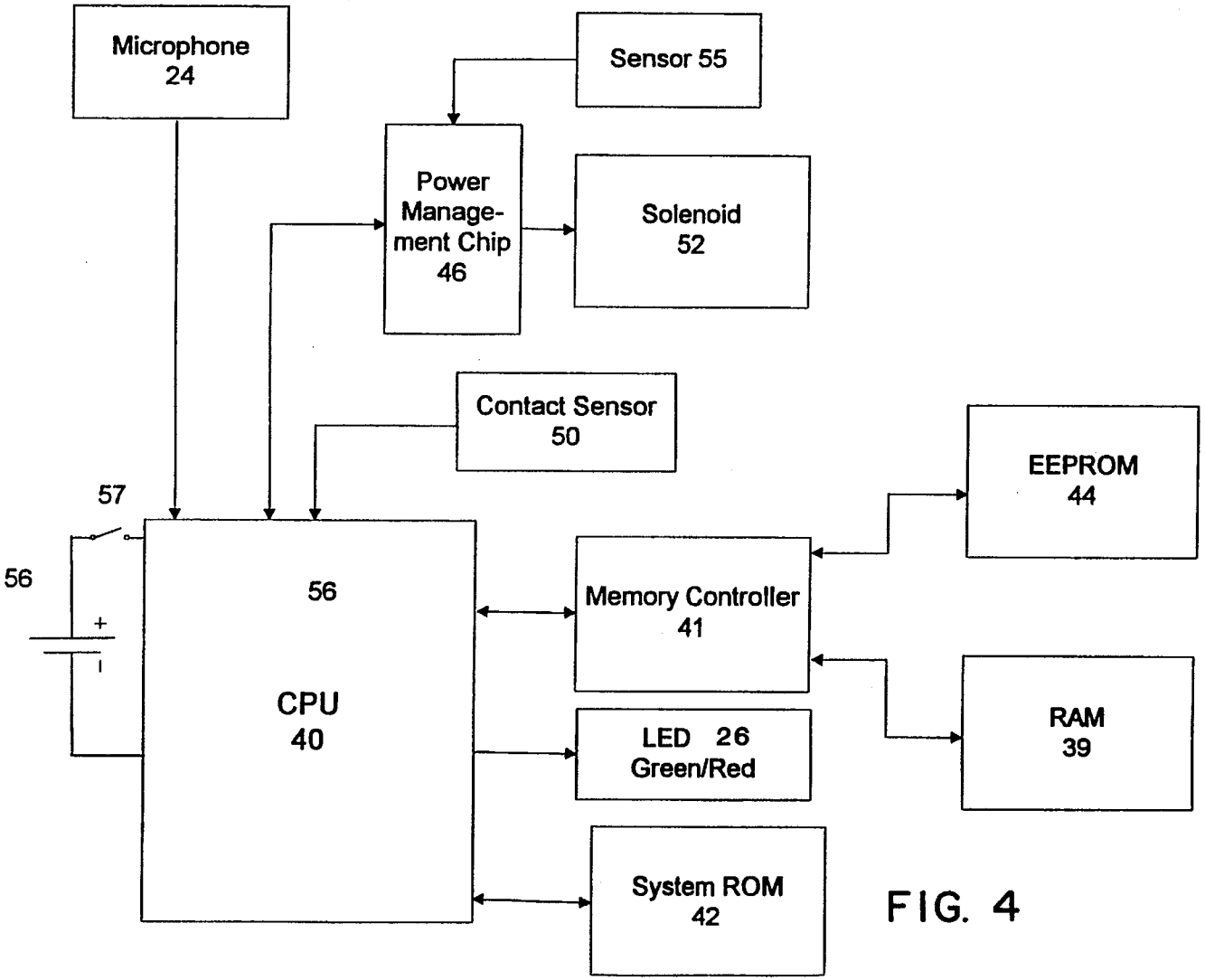
FIG. 4 is a block diagram of the electrical circuitry in accordance with the invention.

Referring to FIG. 4 there is shown a block representation of the electronic circuit 34 of the invention. The central processing unit (CPU) 40 is a high speed, digital coprocessor, such as the Texas Instruments TMSC320C31 DSP chip. This processor can accommodate a sufficient instruction execution rate to support speech processing with no apparent delay to the user. CPU 40 requires a supporting chip set which includes memory controller 41, system read only memory 42, and other structures to support CPU 40. Preferably, permanent memory 44 will be a nonvolatile EPROM or EEPROM memory chip. Power source 56 comprises a long life alkaline battery cell and master power switch 57. All of the circuit components in the present invention are low power devices, as such master power switch 57 should be used only during long periods of inactivity. Ideally the battery life should be approximately six months to allow for continued firearm use without battery replacement. The power source 56 is provided with a low battery indicator such that every time circuit 34 is enabled, a battery check will also be performed. If the battery is judged low, the disabling unit will still be activated, and an audible alarm will be sounded periodically to warn the user of a "dead" battery condition to insure that the safety will still function for several more activation cycles.

The electronic circuit further comprises at least one LED 36 which serves to indicate when the firearm is in an enabled state. Preferably, the electronic circuit of the present invention comprises two LEDs 36, one green LED to indicate that the firearm has been enabled and the other red LED to indicate that the firearm has been disabled. As an alternative to an audible alarm to indicate a low battery condition, one or both LEDs could be used to so indicate by, for example, having one or both flash intermittently to indicate a low battery condition.

The processing of speech signals begins with microphone 24 for converting voice samples to electronic signals. Microphone 24 is preferably located as shown in FIG. 1. However, the microphone 24 may be located on a rear surface 32 of the handle as alternatively depicted in FIG. 2. The signal generated by the microphone is directed to an analog to digital (A/D) converter (not shown) which is comprised of a codec chip such as the TLC32044 in the preferred embodiment. The system components are to be located in the handle. Specifically, the handle of a standard semi-automatic firearm can be slightly widened in order to provide additional space for the circuit components and power source 56. Preferably, the circuit components and disabling unit are located on one side of the handle and the power source 56 is located on the other side. The LEDs 36 are preferably located as shown in FIGS. 1 or 2.

The user is provided with a personal identification number or "PIN" which is spoken when creating the voice sample. The system will thus be tailored to react to a specific voice speaking a particular sequence of numbers. Once the weapon is prepared, the intended user will first activate the system by simply touching the metal surface of the weapon. Contact sensor 50 which consists of a conventional galvanic or capacitive switch is used to sense that contact has been made. The LEDs 36 will then flash to indicate that the voice capture is occurring. Next, the user utters the PIN into microphone 24, creating a signal which is processed by CPU 40 and compared to the previously stored signal in system memory 44. If the signal is verified as the correct voice and correct PIN, green LED 36 is illuminated, and solenoid 52 is activated to rotate blocking lever 54 out of the path of grip safety 33 thereby rendering the weapon ready to fire. Thereafter, the weapon remains active and ready to fire until the grip safety 33 is engaged and released for more than one-half second as described more fully below. Upon release, solenoid 52 rotates to return blocking lever 54 to the blocked position, rendering the weapon safe and incapable of firing.

In use, the officer or other authorized user will utter the PIN only once at the beginning of a shift or exercise. The weapon is then place in the holster in an active state. If the officer must draw his weapon, the act of gripping the weapon will depress the grip safety and render the weapon capable of firing. A contact sensor 55 is provided on the interior of grip safety 54 to indicate to CPU 40 when grip safety 22 has been engaged. Once sensor 55 indicates that grip safety 22 has been disengaged, CPU 40 begins a timing sequence which determines whether grip safety 22 has been released for a specified period of time, preferably one-half second, upon the expiration of the specified time period, CPU 40 commands solenoid 52 to rotate and thereby disable the firearm. If the weapon should for some reason be separated from the officer's hand, upon the expiration of a one-half second period, the weapon would again be rendered safe and incapable of being fired. In this manner, a suspect being apprehended could not gain control of the officer's weapon and be able to fire it. If the officer needs to reactivate the weapon, he need only repeat the PIN into microphone 24.

The first step in utilizing the system of the present invention is to customize the weapon to a particular weapon user. A variety of standard voice processing equipment and methods may be utilized. In order to customize a weapon of the present invention for use by authorized persons only and to further personalize the weapon for use by a specific authorized individual, the intended user's voice must be recorded, processed, and stored within system memory 44 prior to use. In order to accomplish the loading of the PIN into system memory 44, a standard personal computer is fitted with hardware and software which is used to develop voice recognition patterns of an authorized firearm user. For example, under the present invention a law enforcement agency, gun club, firearm dealer or other central location is provided with a stand alone personal computer and associated peripherals required to "burn in" information into memory 44. The personal computer will burn the individualized voice recognition patterns and the secured PIN into the memory chip. Preferably, the memory will be the nonvolatile type, such as an EPROM or EEPROM integrated circuit module. The EPROM or EEPROM is then inserted into the circuit board located in the firearm handle 20. In order to capture and process a user's master PIN, a PC is provided with the necessary system software to manage the recording, processing, and downloading of the user identification information onto EPROM 44. The voice recognition development system is provided with a microphone and A/D converter to permit the system to record a PIN as spoken by the intended user and to record this signal as a digital signal. This signal is further processed by the PC using standard digital signal processing techniques to convert the raw digital representation of the spoken PIN into a more readily usable voice recognition data set.

The verification process of the invention is designed to verify that a particular sequence of numbers has been spoken by a particular speaker. This is referred to as speech recognition. The present invention is also designed to verify that a speaker attempting to access the firearm is the authorized speaker. This is referred to as speaker verification. The overall process of speech/speaker verification will be made after evaluating both speaker and speech recognition components of a detected signal. Although the identification decision could be made based on either component alone, the hybrid decision is even more reliable. The relative decision weights of these two components as well as the over all acceptable error can be adjusted depending on the particular weapon use (i.e. home use versus law enforcement use). It is noted that any conventional voice verification system and method could be utilized and is with in the scope of the invention. Generally, however, microphone 24 first picks up the analog signal representing the spoken PIN. Next, an A/D converter creates a digital version of this analog signal, which is stored as data set in RAM 39. A comparison is then performed between the collected voice sample and the stored voice sample. Where the level of correspondence exceeds a predetermined threshold, it is determined that the speaker is authorized, and system 34 thereby illuminates green LED 36 and removes blocking lever 54, placing the weapon in a ready to fire state.

Significantly, the security and safety mechanism of the present invention provides that only an authorized user will have the ability to enable the firearm. Even if someone, such as a child or criminal suspect, discovers the PIN, the firearm will still remain disabled absent speaker verification. The firearm of the invention is completely unique to a given authorized user. Although multiple authorized users may be provided for a given firearm by storing corresponding voice patterns in the memory 39, 44, it is preferable to have only one authorized user for each firearm.

Figure 5:
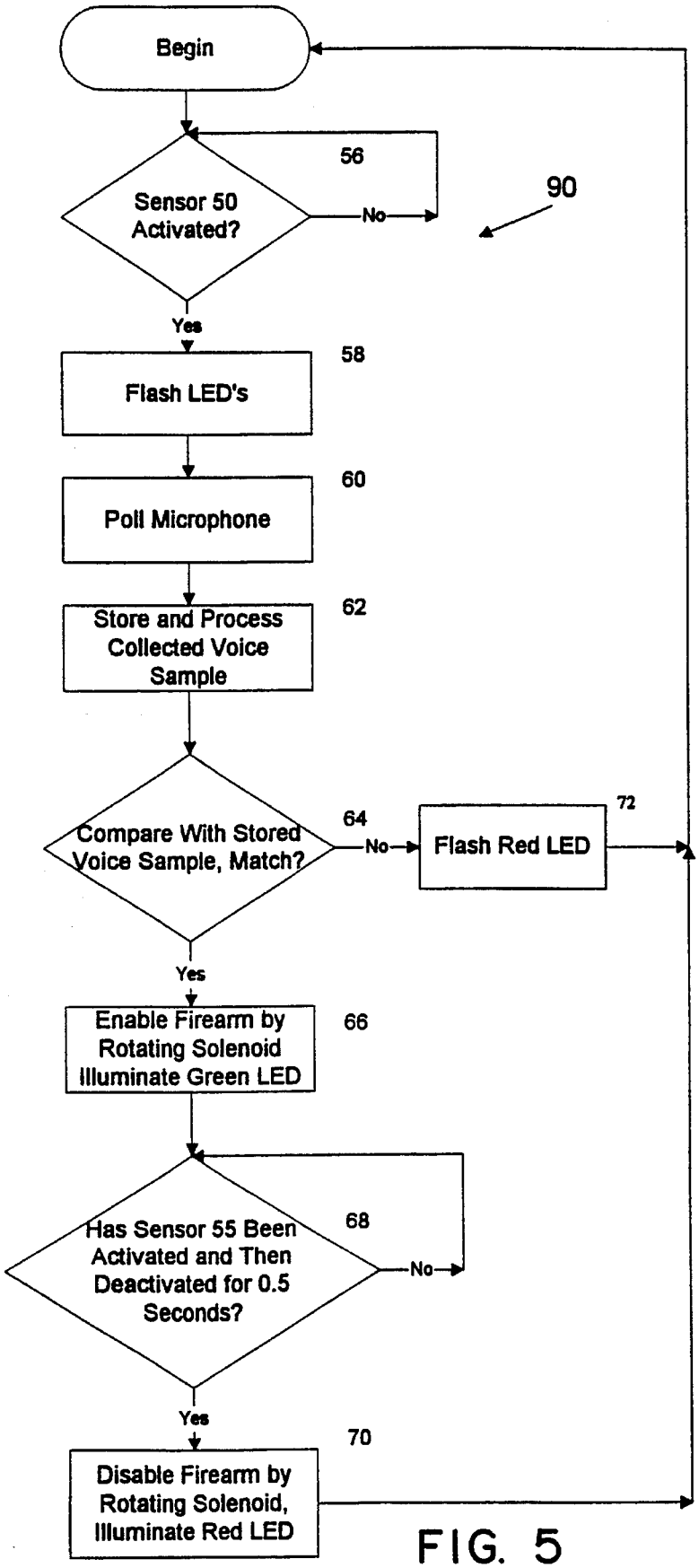
FIG. 5 is a simplified system algorithm in accordance with the present invention.

A simplified system algorithm is shown in FIG. 5. Specifically, the electronic circuitry is first connected to the power source by depressing a power button (not shown) shown as step 56. After an initial activation period the LEDs will begin to flash, shown as step 58, providing notification to the firearm user that the microphone polling period has begun, shown as step 60. At this time, the user will utter the PIN into the microphone, shown as step 62. This collected voice sample is temporarily stored in the memory 39 shown as step 64. In step 64, the collected voice sample is compared to the stored voice sample by a comparator. If the result of the comparison is within an acceptable error, then the solenoid 52 is rotated, thereby retracting the lever bar 54 from the path of the grip safety. If the result of the comparison is unacceptable, then the LEDs will flash alerting the user to provide an additional voice sample.

It is important to note that once the firearm has been activated by the authorized user, the weapon will be in a standard mode of operation and will operate as normal. That is, the thumb safety and the grip safety must first be engaged prior to firing the weapon. Advantageously, the security and safety system of the invention, therefore, provides for a secure and safe operating weapon, while still assuring standard operation so as not to sacrifice firearm performance.

The security and safety mechanism of the present invention provides for an additional safety feature. Referring to FIGS. 2 and 4 there is shown a sensor 50. This sensor is preferably of the contact type. Referring to FIG. 5, there is shown additional steps 68 and 70. After the firearm has been enabled by an authorized user, the firearm remains in the standard mode of operation. However, if a law enforcement officer, for example, is in an altercation and is required to utilize their service weapon, the sensor 55 is contacted by grip safety 22 when the service weapon is grasped by the officer. As conventional, the firing mechanism can now operate to discharge the firearm. However, if the altercation results in the service weapon being removed from the officer, the sensor 55 will signal the CPU 40 which will instruct the solenoid to rotate thereby disabling the firearm as fully set forth above. Thus, if the grip safety is activated and then subsequently deactivated, the sensor solenoid 52 will rotate, and the firearm will be disabled. This safety feature assures that a law enforcement officer will never be injured or killed by their own service weapon.

SUMMARY OF MAJOR ADVANTAGES OF THE INVENTION

After reading and understanding the foregoing inventive firearm security and safety mechanism, in conjunction with the drawings, it will be appreciated that several distinct advantages of the subject invention are obtained.

Without attempting to set forth all of the desirable features of the instant firearm safety and security system, at least some of the major advantages of the invention include a firearm 10 having a grip safety 22 which interacts with blocking unit 48 in order to enable/disable the firearm. Advantageously, the blocking unit 48 can be installed in any standard semi-automatic firearm without the need for costly and difficult firing mechanism alterations.

The verification means of the invention includes microprocessor 40, microphone 24, green and red LEDs 36, and memory 39, 44. The utilization of voice recognition in order to verify that a firearm user is an authorized firearm user provides for a safe and secure firearm that is 100% unique to a given firearm user. The use of voice recognition allows for simplified user verification without the need for hand combinations or inconvenient signal generators.

The verification algorithm utilizes both speech and speaker components thereby increasing recognition accuracy and reliability. Furthermore, the voice sample stored in memory can be easily created by a firearm user on a personal computer, and the EPROM memory chip 44 can be easily changed if a different authorized user is desired for a firearm.

The safety and security mechanism as described provides for a safe and secure firearm 10, while still assuring standard operation. Once enabled by an authorized user, a firearm utilizing the security and safety mechanism of the invention will operate as a standard weapon, thus not inhibiting the performance of the weapon.

The grip safety sensor 55 provides for an additional safety feature vastly improving prior art safety mechanisms. If grip safety 22 is depressed and subsequently released, such as may occur during an altercation with a criminal suspect, the solenoid 52 will rotate thereby placing the blocking lever 54 in the path of the grip safety. The firearm is now disabled and thereby rendered useless to a criminal suspect who may retrieve the weapon.

In describing the invention, reference has been made to a preferred embodiment and illustrative advantages of the invention. Those skilled in the art and familiar with the instant disclosure of the subject invention, however may recognize additions, deletions, modifications, substitutions and other changes which fall within the purview of the subject invention and claims.

What is claimed is:

1. A firearm for use only by an authorized user including a handle having first and second side grip surfaces, a barrel connected to the handle, a firing mechanism, and further comprising:

a grip safety operable between a first position whereby said firing mechanism is inoperable and a second position whereby said firing mechanism is operable such that when an authorized firearm user grasps said handle, said grip safety is caused to move from said first position to said second position thereby permitting said firing mechanism to operate;

a disabling unit comprising solenoid means operably connected to a blocking element, said blocking element movable by said solenoid means between a blocking position whereby said blocking element blocks the grip safety from moving into said second position thereby disabling the firearm and a retracted position whereby said grip safety is permitted to move into said second position thereby enabling the firearm; and identity verification means operably connected to said solenoid means such that only when an authorized firearm user is identified by said identity verification means, said solenoid means is caused to move said blocking element from said blocking position to said retracted position in order to enable the firearm and allow for standard operation.

2. A firearm according to claim 1, wherein said identity verification means comprises:

a microprocessor;

at least one microphone; and memory means for storing a voice sample of an authorized firearm user, whereby during a polling period of said microphone, a voice sample is collected from a firearm user and a comparison is performed between said stored voice sample and said collected voice sample to determine within a predetermined error limit if said firearm user is said authorized firearm user.

3. A firearm according to claim 2 wherein said voice samples consist of speech recognition components and speaker recognition components such that said microprocessor will only indicate that a firearm user is an authorized firearm user if both of said components of said stored voice sample match said components of said collected voice sample within predetermined error limits.

4. A firearm according to claims 3 wherein said speech recognition components consist of a sequence of numerical numbers.

5. A firearm according to claim 2 wherein said memory means comprises a replaceable EPROM chip such that the authorized user of a firearm may be changed by replacing the EPROM chip stored with a first authorized user's voice pattern with that of a second authorized user.

6. A firearm according to claim 1 further comprising a grip safety sensor means located in the handle such that when said handle is grasped by said authorized user thereby moving said grip safety into said second position and thereafter said handle is removed from said authorized user's hand causing said grip safety to move to said first position, the sensor will signal a microprocessor which in turn will cause the solenoid to place the blocking element into a blocking position in order to block the grip safety from thereafter moving into said second position.

7. A firearm according to claim 1 further comprising a power supply means.

8. A firearm according to claim 7 wherein said identity verification means is located within one of said first and second side grip surfaces of said handle and said power supply means is located within the other of said first and second side grip surfaces of said handle.

9. A firearm according to claim 7 wherein said power supply comprises at least one battery.

10. A firearm according to claim 1 wherein at least one LED is located on one of said first and second side grip surfaces of said handle such that when said blocking element is in said retracted position said at least one LED indicates that the firearm has been enabled.

11. A firearm according to claim 10 wherein there are two LEDs on the handle whereby one of said LEDs indicates when said firearm is enabled and the other of said LEDs indicates when said firearm is disabled.

12. A firearm according to claim 2 wherein said microphone is located on one of said first and second side grip surfaces.

13. A firearm according to claim 1 wherein said handle is further defined by front and rear grip surfaces and wherein said grip safety is located on one of said front and rear grip surfaces.

14. A firearm according to claim 13 wherein said grip safety comprises a panel protruding from a one of said front and rear surfaces such that when an authorized firearm user grasp said handle, a portion of said authorized user's hand will cause said panel to move from said first position to said second position.

15. A firearm according to claim 1 wherein said blocking element comprises an elongated bar.

16. A firearm for use only by an authorized user including a handle having first and second side grip surfaces, a barrel connected to the handle, a firing mechanism, and further comprising:

a safety means operable between first and second positions such that said firing mechanism will only operate when said safety means is in said second position;

a disabling unit comprising a solenoid means operably connected to a blocking element, said blocking element movable by said solenoid means between a blocking position whereby said blocking element blocks the safety means from moving into said second position thereby disabling the firearm and a retracted position whereby said safety means is permitted to move into said second position thereby enabling the firearm;

identity verification means operably connected to said solenoid means such that only when an authorized user is identified by said verification means, said solenoid means is caused to position itself such that said safety means is free to move from said first position to said second position;

said identity verification means comprising a microprocessor; at least one microphone; and memory means for storing a voice sample of an authorized firearm user; and whereby during a polling period of said microphone, a voice sample is collected from a firearm user and a comparison is performed between said stored voice sample and said collected voice sample to determine within a predetermined error limit if said firearm user is said authorized firearm user.

17. A firearm according to claim 16 wherein said voice sample consists of speech recognition components and speaker recognition components such that said microprocessor will only indicate that a firearm user is an authorized firearm user if both of said components match said components of said collected voice samples within predetermined error limits.

18. A firearm according to claim 17 wherein said speech recognition component consists of a sequence of numerical numbers.

19. A firearm according to claim 16 wherein said memory means comprises a replaceable EPROM chip such that the authorized user of a firearm may be changed by replacing the EPROM chip stored with a first authorized user's voice pattern with that of a second authorized user.

20. A firearm according to claim 16 further comprising a power supply means.

21. A firearm according to claim 20 wherein said identity verification means is located within one of said first and second side grip surfaces of said handle and said power supply means is located within the other of said first and second side grip surfaces of said handle.

22. A firearm according to claim 20 wherein said power supply comprises at least one battery.

23. A firearm according to claim 16 wherein at least one LED is located on one of said first and second side grip surfaces of said handle such that when said solenoid means is positioned so as not to prevent said safety means from moving from said first position to said second position the LED indicates the firearm is enabled.

24. A firearm according to claim 23 wherein there are two LEDs on the handle whereby one of said LEDs indicates when said firearm is enabled and the other of said LEDs indicates when said firearm is disabled.

25. A firearm according to claim 16 wherein said microphone is located on one of said first and second side grip surfaces.

* * * * *